US009180946B2

(12) United States Patent
Fuhr

(10) Patent No.: US 9,180,946 B2
(45) Date of Patent: Nov. 10, 2015

(54) DEEP-SEA DEVICE FOR RECOVERING AT LEAST ONE DEEP-SEA OBJECT

(75) Inventor: Guenter R. Fuhr, Berlin (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 135 days.

(21) Appl. No.: 13/979,771

(22) PCT Filed: Nov. 7, 2011

(86) PCT No.: PCT/EP2011/005590

§ 371 (c)(1),
(2), (4) Date: Aug. 6, 2013

(87) PCT Pub. No.: WO2012/095123

PCT Pub. Date: Jul. 19, 2012

(65) Prior Publication Data

US 2013/0305975 A1 Nov. 21, 2013

(30) Foreign Application Priority Data

Jan. 14, 2011 (DE) ..... 10 2011 008 558

(51) Int. Cl.

| | |
|---|---|
| ***B63C 7/12*** | (2006.01) |
| ***B63C 7/16*** | (2006.01) |
| ***B63C 7/20*** | (2006.01) |
| ***B63C 11/52*** | (2006.01) |
| ***B63G 8/00*** | (2006.01) |

(52) U.S. Cl.
CPC . *B63C 7/20* (2013.01); *B63C 11/52* (2013.01); *B63G 8/001* (2013.01)

(58) Field of Classification Search
CPC ..... B63C 7/12; B63C 7/16
USPC ..... 114/50–51, 20.1, 312
See application file for complete search history.

(56) References Cited

U.S. PATENT DOCUMENTS

| | | | | |
|---|---|---|---|---|
| 3,147,431 | A * | 9/1964 | Bennett et al. | 324/706 |
| 3,354,658 | A * | 11/1967 | Leonardi | 405/191 |
| 3,732,838 | A * | 5/1973 | Kriedt et al. | 114/333 |
| 3,972,555 | A * | 8/1976 | Tryon | 294/106 |

(Continued)

FOREIGN PATENT DOCUMENTS

| | | |
|---|---|---|
| DE | 944826 | 6/1956 |
| DE | 1805052 | 5/1970 |

(Continued)

OTHER PUBLICATIONS

Koyama, "Cell biology of deep-sea multicellular organisms", Cytotechnology, vol. 55, pp. 125-133 (2007).

(Continued)

*Primary Examiner* — Lars A Olson
*Assistant Examiner* — Jovon Hayes
(74) *Attorney, Agent, or Firm* — Caesar Rivise, PC

(57) ABSTRACT

The invention relates to a deep-sea device for recovering at least one deep-sea object, in particular at least one organism and/or cell material. The deep-sea device comprises a capturing system (14) for accommodating at least one deep-sea object, and a drive unit (16) for driving the deep-sea device. The deep-sea device is designed and equipped in particular to be advanced at least in sections substantially in the buoyancy direction (Ar) toward the water surface. The deep-sea device is designed in particular like a torpedo.

41 Claims, 8 Drawing Sheets

(56) References Cited

U.S. PATENT DOCUMENTS

| | | | | |
|---|---|---|---|---|
| 4,448,145 | A * | 5/1984 | Hervieu | 114/312 |
| 4,854,728 | A * | 8/1989 | Baron et al. | 374/136 |
| 5,381,751 | A * | 1/1995 | Richards et al. | 114/264 |
| 8,833,288 | B2 * | 9/2014 | Bertelsen | 114/326 |
| 8,881,667 | B2 * | 11/2014 | Jung et al. | 114/312 |
| 2003/0179652 | A1 | 9/2003 | Desa et al. | |
| 2010/0042324 | A1 | 2/2010 | Murphy | |
| 2012/0079990 | A1 | 4/2012 | Fuhr et al. | |
| 2013/0305975 | A1 * | 11/2013 | Fuhr | 114/50 |

FOREIGN PATENT DOCUMENTS

| | | | |
|---|---|---|---|
| DE | 2819444 | A1 | 11/1978 |
| EP | 1493656 | A1 | 1/2005 |
| WO | 2008130682 | A1 | 10/2008 |
| WO | 2010145791 | A2 | 12/2010 |
| WO | 2010149572 | A2 | 12/2010 |

OTHER PUBLICATIONS

Shillito et al., "Live capture of megafauna from 2300 m depth, using a newly designed Pressurized Recovery Device", Deep-Sea Research I, vol. 55, pp. 881-889 (2008).

International Search Report for PCT/EP2011/005590 dated Mar. 6, 2012.

* cited by examiner

DEEP-SEA DEVICE FOR RECOVERING AT LEAST ONE DEEP-SEA OBJECT

BACKGROUND OF THE INVENTION

The invention relates to a deep-sea device and a method for recovering (retrieving) at least one preferably biological deep-sea object from the deep-sea, wherein the at least one deep-sea object comprises in particular at least one (vital or inanimate) biological organism and/or cell material of the same.

The deep-sea, even if the expression is not defined in common usage exactly with a depth range, represents the largest biotope of the Earth. In the following, deep-sea should be understood as the area of the oceans, seas or lakes, in which it is almost completely dark and organisms live, which are adapted to the conditions prevailing there (pressure, temperature, nutrient concentration, etc.) to the largest extent possible and must obligately live there the most time of their life span. This area begins approximately at a water depth of 1,000 m and ends, as currently known, at approximately 11,034 m (Mariana Trench, which is considered the deepest point of the Earth's oceans).

The average depth of the seas and oceans of the Earth is greater than 3,000 m and covers a surface of far more than half the globe. Notwithstanding the large areas, the knowledge on this portion of the biosphere is above all limited to the upper areas (down to a depth of approximately 3,000 m) and delimits locally very narrow ranges. This is mainly due to rather selective examinations based above all on technical and logistic problems, as well as to the considerable outlay, which is necessary with increasing depth in order to take deep-sea objects or samples, find, observe animals, or carry out other actions.

The deep-sea organisms are in many respects interesting from the scientific but also economical point of view. With increasing depth, they are obligately "barophilic" resp. "piezophilic", i.e. adapted to the high pressure conditions of the deep-sea. They will not survive a significant pressure change. Technically, a live recovery of macro-organisms (not bacteria) is not even satisfactorily possible at this point in time up to a depth of 2,500 m [B. Shillito, G. Hamel, C. Duchi D. Cottin, J. Sarrazin, P.-M. Sarradin, J. Ravaux, F. Gaill, Live capture of megafauna from 2300 m depth, using a newly designed pressurized recovery device, Deep-Sea Research I 55 (2008) 881-889]. The reasons for the unsuccessful attempts for recovering living organisms or also only living cell material and the long-term stable establishment of propagatable in vitro cell cultures are in particular:

- the increasing adaptation of the organisms to high pressures with rising depth and their constancy in the natural habitat,
- the adaptation to either very constant low temperatures (approximately 1° C.-6° C.+/−0.1° C., psychrophilia) or high temperatures near hot sources (thermophilia) and the resulting low tolerance of the organisms with respect to temperature changes,
- the optimization of almost all macromolecules to high pressures (up to approximately 110 MPa at a depth of approx. 11,000 m) and thus their functional and vitality reduction up to loss at low pressures,
- the obligate piezophilia, which probably occurs from a depth of approximately 5,000 m as well as technical problems with activities like animal husbandry, cell culture, isolation methods, etc. under such high pressures, which have not been solved satisfactorily and in a handy manner up to now,

- the availability of suitable catching and transfer devices from a great sea depth,
- the lack of experience as regards the management of organisms and the lack of knowledge of their physiological properties, nutrition, etc.,
- the considerable time pressure while transporting the animals from the depth to isolation of the cells since, hitherto, no corresponding exactly working transfer systems exist.

In particular, the following two reasons have for decades made the recovery of deep-sea objects, preferably of at least living tissue material of deep-sea macroorganisms, necessary.

First, a necessity for scientific studies. Deep-sea organisms of whatever species can only be transferred alive to a laboratory husbandry or at least via the cultivation of cells to the regular laboratory cultivation operation, since any provision of sufficient material for research then also exists. The deep-sea can only be visited in the short term. No permanent laboratory unit exists at this point in time and would be comparable, as far as the technical complexity is concerned, with a space station. On the other hand, the desire for economical exploitation of larger stocks or to have a correspondingly large amount of biomaterial available for commercial use. Only in biolaboratories on the Earth's surface can cells, macromolecules and other substances of the deep-sea organisms be isolated in sufficient quantities, and animals, or also cells, if applicable, be cultivated and expanded to the required quantities, modified and thus economically used, since the organism density of the deep-sea is mostly extraordinarily low and thus doesn't allow for commercial captures.

For biotechnology, living cells, small tissue complexes and macromolecules are above all interesting, whereas for science the vital animals are rather of primary interest. Also the stabilization of isolated, living cells and their culture was up to now successful only up to unsatisfactory depths. For deep-sea organisms of the megafauna, this is a depth of approximately 1,162 m [S. Koyama, Cell biology of deep-sea multicellular organisms, Crytotechnology (2007) 55:125-133]). Here, besides this, it was hitherto all about organisms, which tolerate a significant pressure drop to normal pressure to a great extent, i.e. are not obligately piezophilic (e.g. the deep-sea eel). The majority of the obligate deep-sea organisms are located at greater depth and therefore hitherto have not been represented and accessible with their macro-organism spectrum in laboratory cell cultures.

Hitherto, the following two approaches are substantially followed for recovering deep-sea objects.

First, the recovering of the deep-sea objects caught without maintaining the depth pressure at the place of catching. On the other hand, the recovering in pressure chambers on deep-sea vessels and transferring to the surface with more or less good maintenance of the pressure in the original area of life of the deep-sea object caught. In the first option, only organisms, which are not macro-organisms (e.g. bacteria) and are not obligately piezophilic can survive. The methods are therefore limited to depths that are smaller than approximately 2,000 m. The second option implies ascent times in the hour range and requires therefore very exact thermostating and pressure stabilizations. Also, significant depth limits are set here, and no vital recoveries were successful, except the said ones.

It can be assumed that from the sum of said reasons for a live recovery of macro-organisms of the deep-sea resp. the installation of cell cultures from intact cells of an obligately piezophilic organism (e.g. fish, crustacean, etc.) novel devices and methods are required, i.e. the currently known technology with the approach of catching chambers which can be adjusted more or less well in terms of pressure and temperature is not sufficient.

An essential reason for the loss of vitality of the whole organism as well as the life processes at the cellular level consists in the currently required long ascent times from a great depth in mostly sub-optimal marginal conditions (in particular pressure, temperature, light). This way, the ascent operation has, for a depth of 7,000 m and an already favourable ascent speed of a conventional underwater vessel or conventional catching system of 1 m/s a duration of 7,000 s, i.e. almost 2 hours. With the time period necessary for the recovery, the time required until removal of the organism is mostly equal to several hours.

With respect to the general prior art, reference is also made to WO 2010/145791 A2, which, however, only describes a very slow, passive buoyancy of a catching device e.g. by means of a balloon and is thus not suitable for the purpose of the invention. Reference is also made to EP 1 493 656 A1, which describes a conventional submarine, which is, however, not suitable for the deep-sea and thus not suitable for the purpose of the invention.

An object of the invention is to create an improved deep-sea device and an improved method for the recovery of at least one deep-sea object.

In particular, it is an object of the invention to create a deep-sea device and an associated method, which allow the vital recovery of at least one deep-sea object (preferably a macro-organism) at least at the cellular level and optionally to transfer cells into a stable propagatable in vitro culture.

These objects are achieved in particular with a device and a method having the features of the invention.

DESCRIPTION OF THE INVENTION

The invention relates in particular to the general technical teaching, in contrast to the currently known approaches, to recover (retrieve) at least one deep-sea object as fast as possible from the deep-sea.

According to the invention, a deep-sea device for recovering at least one preferably biological deep-sea object is provided.

The at least one deep-sea object comprises in particular at least one vital and/or inanimate organism and/or cell material of the same, but also any other types and forms of objects and materials present in the deep-sea (e.g. fishes, crustaceans, unicellular organisms, macromolecules, tissue complexes, etc.). The organism is preferably a biological organism, which in particular comprises at least one biological cell, preferably microbial or animal cells of lower or higher organisms.

The deep-sea device comprises a catching and/or receiving means in order to accommodate and in particular to catch at least one deep-sea object in the deep-sea, and a drive unit in order to actively drive the deep-sea device.

The deep-sea device is preferably formed and configured in order to be driven forward between the deep-sea and the water surface at least in sections substantially in the buoyancy direction toward the water surface (preferably by means of the drive unit), in particular driven forward torpedo-like toward the water surface.

The deep-sea device can, but does not have to be driven forward the whole way from the deep-sea to the water surface substantially in the buoyancy direction. It is also possible that the deep-sea device is driven forward on the way from the deep-sea to the water surface in sections deviating from the buoyancy direction, e.g. in order to surface in a specific target region on the water surface.

The buoyancy direction is counter to the gravity force direction and/or cuts a fictitious flat water surface at right angle.

Preferably, the deep-sea device is formed substantially torpedo-like. "Torpedo-like" within the context of the invention comprises in particular at least one of the following properties: The form of a usual torpedo optionally plus further parts, the size of a usual torpedo, the speed that can be reached by a conventional torpedo (i.e. a speed greater than 25 km/h, 50 km/h, 75 km/h or 100 km/h), the ability to be moved, deviating from a horizontal direction, preferably substantially in the buoyancy direction in a defined manner.

By means of the deep-sea device according to the invention, ascent times from the deep-sea can be significantly reduced, e.g. from a water depth of 7,000 m, to less than 10 minutes. Thus, with actively driven conventional torpedoes, speeds of more than 100 km/h can be achieved, which corresponds e.g. at a water depth of 7,000 m to an ascent time of approximately 5 minutes.

It is possible that the deep-sea device is formed and configured in order to preferably passively sink to the deep sea bed. But it is also possible that the deep-sea device is formed and configured in order to be maintained in a deep-sea depth target region, spaced apart, above the deep sea bed.

It is possible that the deep-sea device is formed and configured in order to be oriented in the deep-sea substantially in the buoyancy direction, in particular erected, preferably in such a way that the head end of the deep-sea device points toward the water surface and the drive unit points toward the deep sea bed. In other words, the deep-sea device is preferably formed and configured in order to be oriented in the deep-sea in such a way that the longitudinal axis of the deep-sea device is substantially parallel to the buoyancy direction resp. substantially corresponds to the buoyancy direction and/or is oriented substantially perpendicular to a fictitious flat water surface.

It is possible that the deep-sea device is formed and configured in order to be driven forward at least in sections oriented substantially parallel to the buoyancy direction, preferably in such a way that the head end of the deep-sea device points toward the water surface and the drive unit points toward the deep sea bed. Here, in other words, the longitudinal axis of the deep-sea device is substantially oriented parallel to the buoyancy direction resp. substantially corresponds to the buoyancy direction and/or is oriented substantially perpendicular to a fictitious flat water surface.

The deep-sea device may comprise a preferably droppable weight means and/or a buoyancy unit.

Preferably, a head end region of the deep-sea device comprises the weight means and/or the buoyancy unit.

In particular, the head end region of the deep-sea device comprises e.g. the head side third, the head side fourth or the head side sixth of the deep-sea device.

The weight means is formed in order to preferably form the head end of the deep-sea device during the sinking process of the deep-sea device. This can e.g. ensure that the deep-sea device sinks headfirst and in particular with the weight means ahead, whereby this can advantageously allow that the deep-sea device hits the deep sea bed headfirst and/or it can be prevented that the deep-sea device hits the deep sea bed with the drive unit, the catching device or other sensitive parts.

Preferably, the weight means can be dropped from the deep-sea device by means of a dropping mechanism.

The dropping mechanism is preferably formed and configured in order to drop the weight means in the deep-sea depth target region (e.g. on the deep sea bed or spaced apart above the deep sea bed).

The buoyancy unit is preferably formed in the head end region of the deep-sea device, in particular underneath the weight means, in order to orient and/or erect the deep-sea device in the deep-sea, preferably after the weight means has been dropped. When the deep-sea device has been oriented this way, the longitudinal axis of the deep-sea device is in turn substantially oriented parallel to the buoyancy direction resp. substantially corresponds to the buoyancy direction and/or is oriented substantially perpendicular to a fictitious flat water surface. Here, in particular, the head end of the deep-sea device points toward the water surface and the drive unit points toward the deep sea bed.

It is possible that, prior to dropping the weight means, the weight means forms the head end of the deep-sea device, whereas after dropping the buoyancy unit forms the head end or is at least positioned as close as possible to the head end.

The buoyancy unit is formed and configured in order to generate a preferably static buoyancy. It is possible that the buoyancy unit comprises a buoyancy fluid (preferably a buoyancy gas) and/or a buoyancy mass (e.g. a glass hollow sphere system, glass hollow sphere cement mixture, etc.).

Preferably, the weight force of the weight means exceeds the buoyancy force of the buoyancy unit.

Preferably, the deep-sea device is formed and configured in order to passively or autonomously sink into the deep-sea.

The catching device may be pressure-controllable and/or temperature-controllable. For this purpose, the deep-sea device may comprise a temperature control device and/or a pressure adjusting device.

The catching device is preferably formed and configured in order to ensure, for at least one accommodated deep-sea object, a temperature, which substantially corresponds to the temperature in the deep-sea accommodating area.

Furthermore, the catching device may be formed and configured in order to ensure, for at least one accommodated deep-sea object, a pressure, which substantially corresponds to the pressure in the deep-sea accommodating area.

Since it can be found in the literature that a short pressure relief leads to reversible changes in the conformation and function of cellular macromolecules, short recovering times according to the invention even allow for a catching device whose interior always follows the external pressure, in particular if the cell material is again subjected to the initial pressure or immediately cryopreserved after the recovery. Since the pressure relief of the cell material and tissue material should be as short as possible, the active and fast recovery is of decisive significance to allow for at least isolating still vital cell material e.g. for establishing in vitro cultures.

Consequently, the catching device may be formed and configured in order to ensure, for at least one accommodated deep-sea object, a pressure, which substantially follows the external pressure or the ambient pressure.

The catching device may thus be pressure resistant (for e.g. more than 50 MPa, more than 75 MPa, more than 100 MPa or more than 110 MPa) or also be designed pressure-free.

Preferably, the catching device comprises a chamber, in particular a catching chamber for at least one deep-sea object.

The catching device may furthermore comprise a determination unit in order to detect whether one or more deep-sea objects are accommodated.

The chamber is preferably a chamber that is closable by means of a closing means. The closable chamber is closed e.g. when a determination unit has determined the existence of one or more deep-sea objects in the catching device.

The catching device may furthermore comprise an attractant for attracting at least one deep-sea object into the catching device.

In addition, the catching device may comprise a suction device for sucking deep-sea water and in particular at least one deep-sea object into the catching device and/or a filtering or screening (sieve) device for screening out or capturing at least one deep-sea object from the deep-sea water.

Preferably, at least one deep-sea object is impinged by means of the suction device against the screening device.

Furthermore, the deep-sea device may comprise one or more preparation devices in order to prepare at least one deep-sea object accommodated in the catching device, e.g. after a determination unit has determined the existence of at least one deep-sea object in the catching device and/or already prior to surfacing of the deep-sea device from the water surface, e.g. already in the deep-sea and/or while the deep-sea device is driven forward toward the water surface.

For example, a preparation device may be provided for in order to fix at least one deep-sea object accommodated in the catching device e.g. by means of penetration and/or to fraction and/or to kill it e.g. by means of cutting. For this purpose, the preparation apparatus may comprise fixing and/or dismantling parts in the form of cutting means and/or piercing means. Preferably, at least one deep-sea object is fractionated and/or fixed in a sandwich-like manner.

Furthermore, a preparation apparatus may be provided for in order to provide at least one active agent for at least one deep-sea object accommodated in the catching device.

The active agent may be e.g. at least one preserving substance, at least one nutrient medium, at least one enzyme solution (in particular for dissolution of a tissue complex of a deep-sea object) and/or at least one cryoprotectant (in particular for maintaining the vitality of at least one deep-sea object).

Preferably, the preparation device and/or the catching device is formed and configured in order to isolate at least one accommodated deep-sea object substantially from surrounding water, e.g. by means of displacement or impingement (sucking or pressing) of the surrounding water out of the preparation device and/or the catching device, whereby, advantageously, e.g. the active agent is not diluted undesirably or rinsed out with water or, generally, the preparation is not impaired by water.

It is, however, also possible that the preparation device and/or the catching device is formed and configured in order to recover at least one accommodated deep-sea object surrounded by surrounding water, e.g. by means of leak-proof closing, so that (deep-sea) water accommodated in the preparation device and/or the catching device cannot escape.

The deep-sea device preferably has an elongated main body. The elongated main body may be a metallic, plastic and/or ceramic construction.

The elongated main body may substantially have a cylindrical and/or conical form. Furthermore, the elongated main body may be formed as a single-part or multiple-part body.

Preferably, the catching device resp. the chamber is integrated removably and re-attachably in the inside of the elongated main body, in particular together with at least one deep-sea object accommodated therein.

It is possible that the catching device is removable (and preferably re-attachable) at least in sections, i.e. in parts or completely, preferably in a modular manner and/or together with at least one deep-sea object accommodated therein, from the deep-sea device, e.g. in order to ensure a rapid post-treatment of at least one deep-sea object accommodated therein.

The catching device may comprise a connecting device for connecting to an external pressure system. It is thus advantageously possible to rapidly remove the catching device completely or partially with at least one deep-sea object accommodated therein or a portion thereof after the recovery and to connect it to another pressure system and, in addition or alternatively, to post-treat it as a whole subassembly or in parts with the at least one accommodated deep-sea object (e.g. cells, tissues or the whole caught organism), e.g. deep-frozen (cryopreserved).

The catching device may be removable and preferably re-attachable by means of a quick release from/to the deep-sea device. Likewise, the section of the catching device, which is removable from the remaining catching device, can be fixed in a removable and preferably re-attachable manner by means of a quick release from/to the catching device or any other suitable portion of the deep-sea device.

The deep-sea device may furthermore comprise at least one spacer device in order to prevent that an inlet opening of the catching device lies on the deep sea bed and is thus closed by the deep sea bed. Preferably, the spacer device is stirrup-shaped and/or extends over the inlet opening of the catching device. Preferably, the spacer device furthermore serves as a protection device in order to prevent, for example, that the sensitive catching device is damaged when hitting the deep sea bed.

It is possible that the drive unit is formed as a propeller drive unit and/or recoil drive unit. Furthermore, the drive unit may be formed as screw drive unit, preferably as a double screw drive unit.

The drive unit is preferably formed and configured in order to drive the deep-sea device with a speed, which is greater than: 25 km/h, 50 km/h, 75 km/h, 100 km/h, 125 km/h or 150 km/h.

Furthermore, the deep-sea device may have a signal device (e.g. radio, light, reflectors, etc.) in order to allow for rapid localization (e.g. in case of drifting).

The deep-sea device may also comprise an adjustment system for adjusting (e.g. controlling, regulating, setting, etc.) the speed and/or the direction of movement of the deep-sea device in particular during the surfacing in order to compensate e.g. a drifting or any otherwise unintentional directional deviation and/or to ensure surfacing of the deep-sea device in a target region on the water surface.

Likewise, it is possible that the deep-sea device comprises a sensor device for detecting an e.g. acoustic directional beam. In addition, it is possible that the deep-sea device comprises a determining means (in particular a sensor or measuring equipment) by means of which the position and/or the depth and/or the orientation resp. the direction of movement of the deep-sea device can be detected, ascertained, measured resp. determined. For example, depending thereon, the direction of movement and/or the speed of the deep-sea device can be adjusted during surfacing. Furthermore, for example, depending thereon, the surfacing speed of the deep-sea device can be adjusted and/or sinking of the deep-sea device stopped in order to keep the deep-sea device in a deep-sea depth target region above the deep sea bed, e.g. in such a way that the weight means is dropped and the buoyancy unit is formed and configured in such a way that the deep-sea device does not leave the deep-sea depth target region, that is neither sinks nor rises. It is also possible that the deep-sea depth target region is maintained by means of the drive unit or in any other suitable way.

The determination of the depth of the deep-sea device may in particular take place by means of a detected water pressure or in a light-based manner. The depth may comprise the distance between the deep-sea device and the water surface and/or the distance of the deep-sea device above the deep sea bed.

The deep-sea device is in particular designed for a range of application of between approximately 1,000 m and approximately 11,000 m.

The deep-sea device is preferably formed as deep-sea probe and/or is unmanned and functions preferably autonomously.

It is possible that the drive by means of the drive unit is pre-programmed.

The invention also comprises a method for recovering (retrieving) at least one deep-sea object by means of a deep-sea device, preferably a deep-sea device as described herein.

For this method, at least one deep-sea object is accommodated in the deep-sea by means of a catching device and the deep-sea device is driven after the accommodation by means of a drive unit.

It is possible that the deep-sea device is driven forward between the deep-sea and the water surface at least in sections substantially in the buoyancy direction toward the water surface (preferably by means of the drive unit). Alternatively or in addition, the deep-sea device may be formed torpedo-like, in particular driven forward torpedo-like toward the water surface.

Further process steps according to the invention result from the associated description of the deep-sea device.

BRIEF DESCRIPTION OF THE DRAWINGS

The above features and embodiments according to the invention can be combined with one another in any desired manner. Other advantageous developments of the invention are disclosed or are evident from the following description of the preferred exemplary embodiments in conjunction with the attached figures, wherein:

The embodiments shown in the figures are partially concurrent, wherein similar or identical parts are designated with the same reference sign, and for the explanation of which reference is also made to the description of one or more other embodiments in order to avoid repetitions.

FIG. 1 shows an exemplary representation of a deep-sea device 1 for retrieving (recovering) at least one deep-sea object 13, e.g. in the form of an (preferably vital biological)

organism and/or cell material of the same. The deep-sea device 1 is formed as an unmanned, torpedo-like deep-sea probe.

The preferred aim of the deep-sea device 1 is to realize the hitherto unsuccessful transfer of living organisms of the macrofauna from the deep-sea, wherein the recovery of vital whole organisms is not in the foreground of the endeavours, although it is intended; it is rather sufficient to find living cells in them on the surface, from which then, e.g. in suitable pressure-controlled cell culture systems (cf. B. Shillito, G. Hamel, C. Duchi D. Cottin, J. Sarrazin, P.-M. Sarradin, J. Ravaux, F. Gaill, Live capture of megafauna from 2300 m depth, using a newly designed pressurized recovery device, Deep-Sea Research I 55 (2008) 881-889)) long-term stable, propagatable suspension or surface cultures of cells of the caught organisms can be established in the laboratory.

The deep-sea device 1 comprises a catching device 14 in order to accommodate and to catch at least one deep-sea object 13, and a drive unit 16 in order to actively drive the deep-sea device 1.

Figure 15:
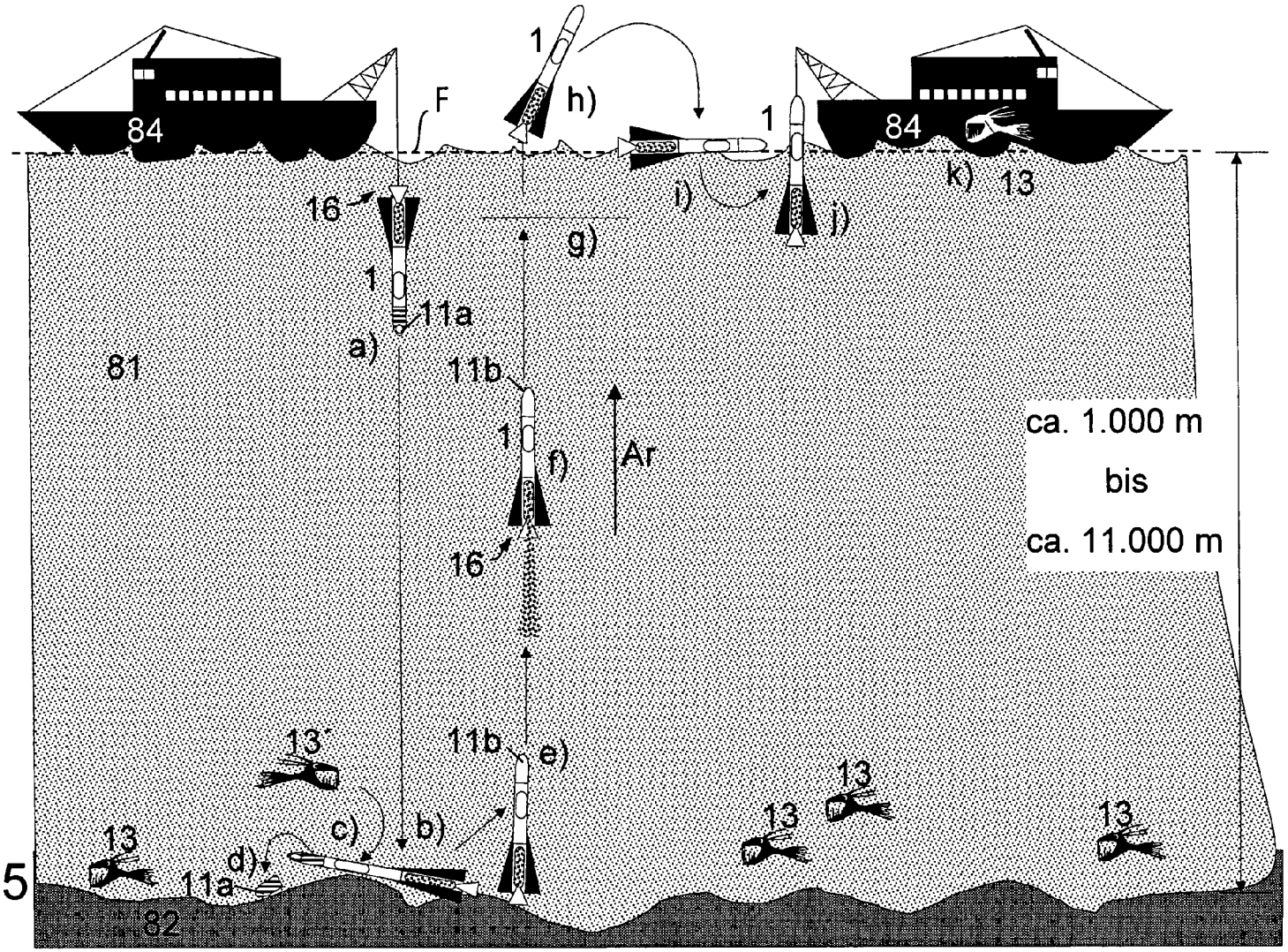
FIG. 15: shows a schematic representation of an embodiment of a procedure according to the invention for recovering at least one deep-sea object.

The deep-sea device 1 is formed and configured in order to be driven from the deep-sea by means of the drive unit 16 substantially in the buoyancy direction Ar, thus substantially vertical to a fictitious flat water surface, toward the water surface (see FIG. 15).

Figures 1, 2:
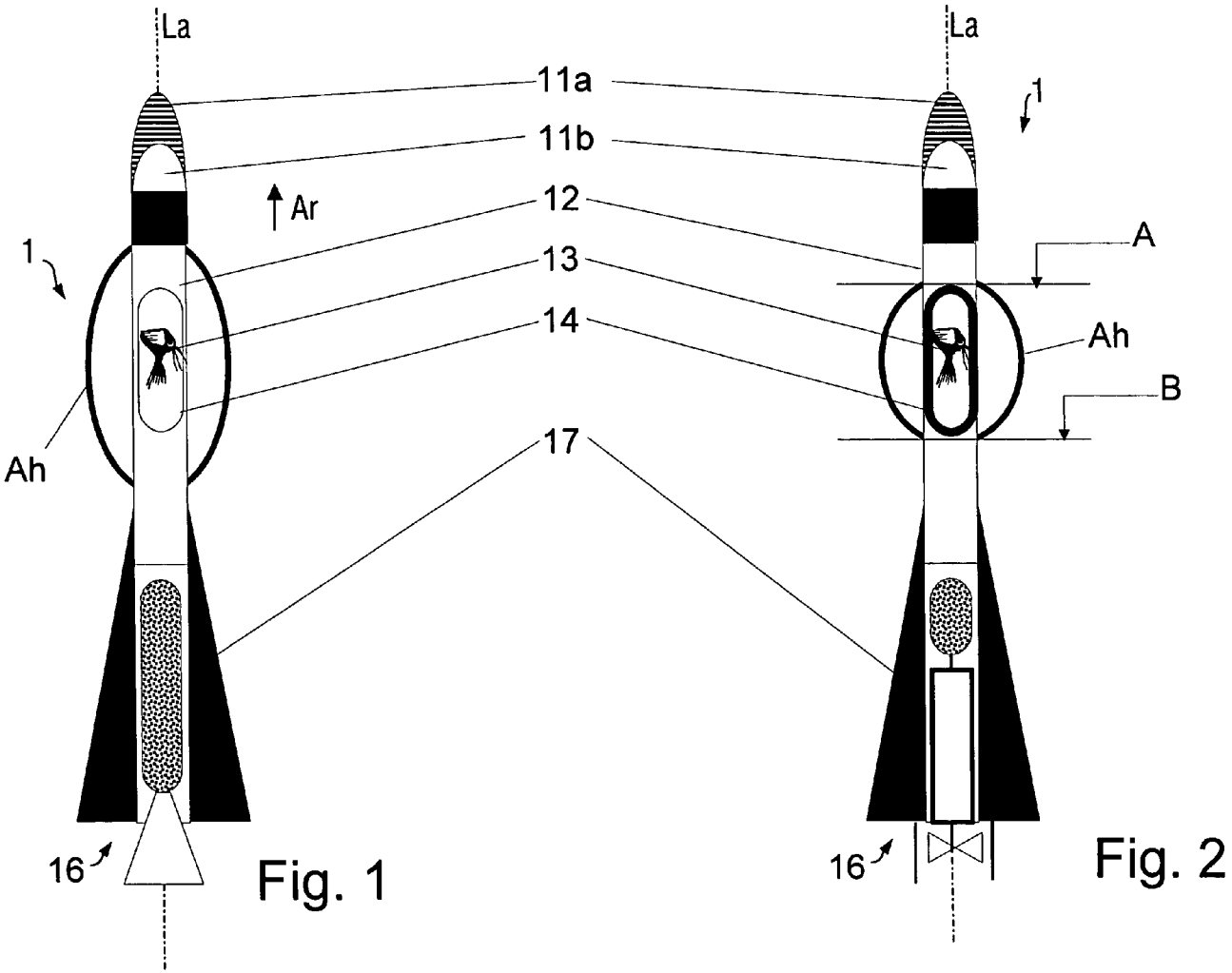
FIGS. 1 to 5: show schematic sectional views of different embodiments of a deep-sea device according to the invention or sections thereof.

As can be seen in FIG. 1, the deep-sea device 1 is formed torpedo-like. The deep-sea device 1 comprises, however, no explosive device and is not used horizontally as usual for torpedoes, but rather in order to be moved substantially in the buoyancy direction Ar toward the water surface.

Furthermore, the deep-sea device 1 is formed and configured in order to be moved oriented substantially parallel to the buoyancy direction Ar toward the water surface, i.e. in such a way that the longitudinal extension and thus the longitudinal axis La of the deep-sea device 1 is oriented substantially parallel to the buoyancy direction Ar or substantially conforms with the buoyancy direction Ar.

The deep-sea device 1 has a head end region. On or in the head end region is arranged a weight means 11*a*, which is droppable by means of a dropping mechanism and is formed as a weight hood, and a buoyancy unit 11*b*, which is formed as a buoyancy body.

Prior to dropping the weight means 11*a*, the weight means 11*a* forms the head end of the deep-sea device 1, whereas after dropping the buoyancy unit 11*b* forms the head end or is at least positioned as close as possible to the head end.

The weight of the weight means 11*a* clearly exceeds the buoyancy of the buoyancy unit 11*b*. The weight means 11*a* ensures, after the watering, that the deep-sea device 1 sinks with the weight means 11*a* ahead on the deep-sea ground or a deep-sea target depth region.

The deep-sea device 1 furthermore comprises a cylindrical, at least partially hollow main body 12, which indirectly or directly has the drive unit 16 on its rear end and indirectly or directly has the weight means 11*a* and/or the buoyancy unit 11*b* on its head end.

The deep-sea device 1 and its functional parts are, wherever this can be avoided, not provided with gas spaces, so that no pressure-resistant containers are required, which is e.g. achieved by cast-in electronics, compartments communicating with the external space, motors, etc. and a pressure-tolerant battery system as are already being applied nowadays.

The catching device 14 shown in FIG. 1 is formed in order to be in hydraulic connection with the external space, in particular water, and may thus be formed thin-walled, as a non pressure-stable part.

Reference sign Ah identifies a spacer device, which comprises a plurality of stirrups in order to prevent that an inlet opening (not represented in FIG. 1) of the catching device 14, through which a deep-sea object 13 can enter the catching device 14, lies on the deep-sea ground and is thus closed by the deep-sea ground. Simultaneously, the spacer device Ah is provided for in order to prevent damaging the catching device 14 when the deep-sea device 1 hits the deep sea bed. Preferably, a plurality of stirrups, preferably four or more stirrups, are provided for with an offset of 90°.

The drive unit 16 is shown in FIG. 1 as a gas drive system comprising a nozzle and a gas reservoir, which allows in particular high speeds so that the recovery of a deep-sea object 13 from the deep-sea is possible within the shortest possible time. The highly pressurized gas can flow out of the gas reservoir through the nozzle. The gas reservoir is in particular a liquid gas reservoir, wherein the gas formation and the propulsion occur by combustion. A plurality of gas containers with the combustion components, mixing chambers and combustion elements can also be provided for (not depicted here).

The deep-sea device 1 furthermore has a plurality of side elements 17, preferably four of them, in order to stabilize the movement of the deep-sea device 1 in particular during the surfacing. The side elements 17 are formed in particular as rear fins.

Attracting and catching a deep-sea object 13 may be carried out in various ways. This is first the sucking of surrounding water, flowing through the catching device 14 and screening-out of at least one deep-sea object 13, which remains in the catching device 14. To do this, for example, a pump system and control electronics are required (not depicted in FIG. 1). It is also possible that a deep-sea object 13 is attracted into the catching device 14 e.g. by means of a bait, which was already brought into the catching device 14 prior to watering.

In order to determine whether at least one deep-sea object 13 is accommodated in the catching device 14, the catching device 14 may comprise a determination unit (e.g. sensors, light barriers, movement detectors, contact sensors, etc.). If the existence of one or more deep-sea objects 13 is determined, the deep-sea object 13 is caught in the catching device 14, e.g. by closing the inlet opening Eö of the catching device 14 by means of a closing means or the deep-sea object 13 is fixed in the catching device 14.

After a deep-sea object 13 has been caught, the weight means 11*a* may be dropped. Through the action of the buoyancy by means of the buoyancy unit 11*b* on the head end region of the deep-sea device 1, the deep-sea device 1 erects itself in the buoyancy direction Ar and, optionally, a passive or static surfacing may occur. After the orientation or programmed later, the active drive is started by the drive unit 16, whereby the deep-sea device 1 is driven forward oriented substantially parallel to the buoyancy direction Ar substantially in the buoyancy direction Ar toward the water surface, namely with high speed, e.g. more than 50 km/h. The surfacing may be supplemented by a control or adjustment device, which allows corrections of the direction or compensates drifting, whereby surfacing in a target region on the water surface can be ensured.

At speeds of more than approximately 30 km/h, the deep-sea device 1 shoots out from the water surface and may hit and damage a vessel on the water surface. If this must be avoided, the water pressure may e.g. be detected by means of measuring equipment and, shortly before reaching the water surface, the speed may be reduced in a defined manner. The position detection may also be carried out through photometry. On the other hand, shooting out of the deep-sea device 1 from the water surface may even be desired in order to allow for rapid identification of the place of surfacing. In the case of a small or already fractionated deep-sea object 13 in the catching device 14, aiming at recovering merely vital cells, hitting the water surface and the associated impact should be unproblematic.

In order to find the deep-sea device 1 also with e.g. unfavorable sight conditions, high waves or in the night, the deep-sea device 1 may comprise a signaling device in order to (preferably after the surfacing) emit radio signals, light flashes, acoustic signals or other localization signals.

After the recovery of the deep-sea device 1 e.g. on a ship, or already when reaching the deep-sea device 1 e.g. by means of a smaller boat, the complete catching device 14 or at least one section of the catching device 14 comprising the at least one deep-sea object 13 may be removed from the deep-sea device 1 and e.g. further treated on the spot, for example frozen (cryopreservation) or brought on board of a ship with laboratories. In the latter, e.g. a cell isolation or a transfer of cells, tissue parts or also of the whole organisms in pressure chambers, etc., can then be carried out.

A particularity of the embodiment shown in FIG. 2 is that the catching device 14 is deep-pressure stable, in particular formed as a deep-pressure stable, thick-walled chamber. While the catching device 14 from FIG. 1 is more directed at the recovery of living cells and not vital organisms, the catching device 14 from FIG. 2 can allow both the recovery of living cells and vital organisms. A further particularity of the embodiment shown in FIG. 2 is that the drive unit 16 is formed as an electric drive comprising a battery, an electric motor and a drive part. The drive part may be formed as a propeller or screw and, for compensation of a torque, preferably as an antagonistic double screw system.

The catching devices 14 shown in the FIGS. 1 and 2 are fixed on the main body 12 in a modular manner removably and re-attachably with a quick release, this allowing multiple use. After the surfacing, the catching device 14 may therefore be rapidly removed with the accommodated deep-sea object 13 and is more handy for the further use of the deep-sea object 13. The removal of the catching device 14 is carried out within the range A-B (cf. FIG. 2).

Figure 3:
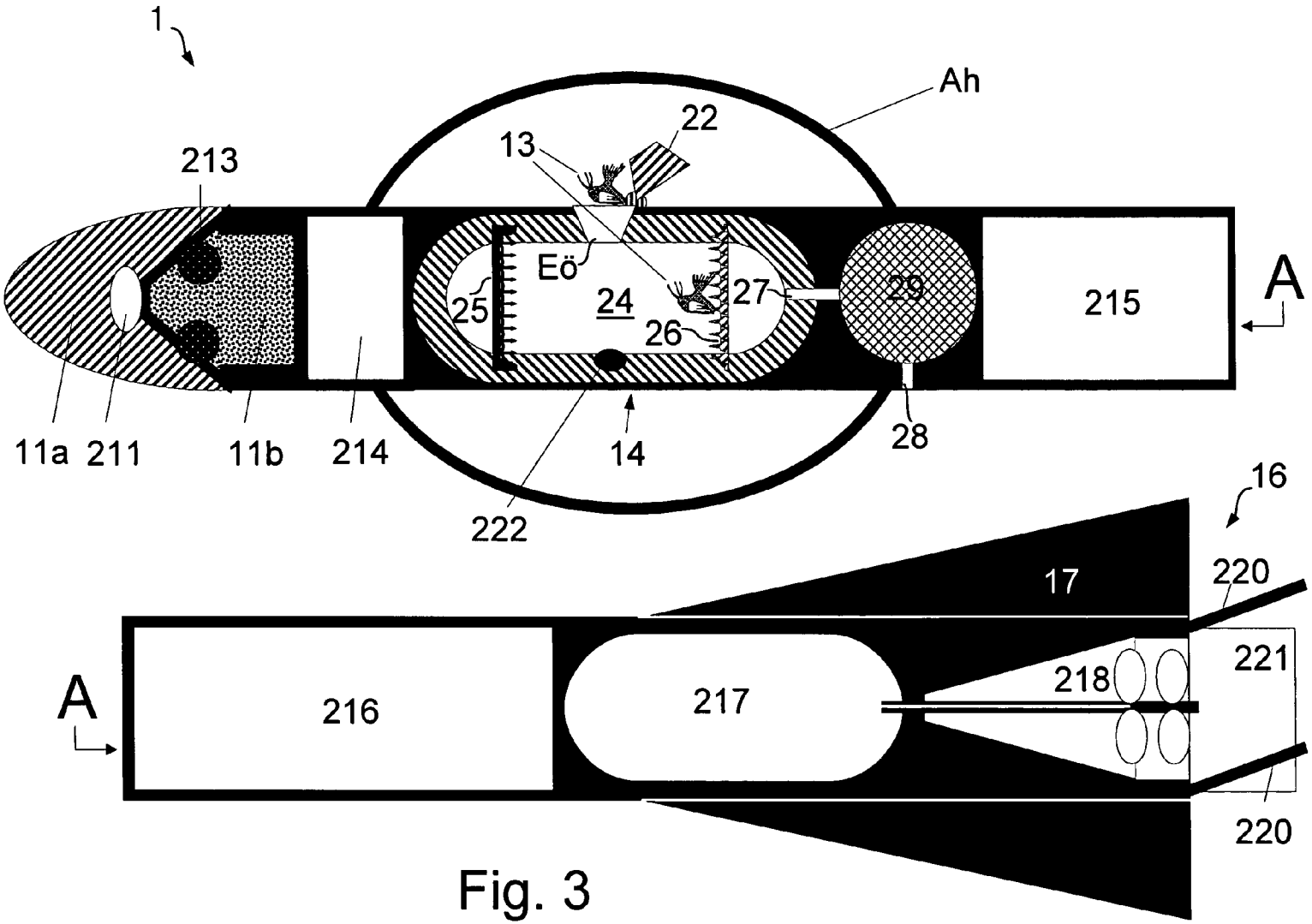

FIG. 3 shows a more detailed representation of the deep-sea device 1. A cut is performed at position A, so that the rear portion of the deep-sea device 1 is represented under the front portion of the deep-sea device 1. In fact, they both form a linear unit.

On or in the head end region of the deep-sea device 1 are located the weight means 11*a* and a dropping mechanism 211 for the weight means 11*a*. The dropping mechanism 211 may e.g. be a small detonator, which projects away the weight means 11*a* in the sea depth, or a spring mechanism, which is triggered e.g. electro-mechanically and which drops the weight means 11*a*. Likewise located on or in the head end region of the deep-sea device 1 and under the weight means 11*a* is the buoyancy unit 11*b*, which erects the deep-sea device 1 toward the water surface after the dropping of the weight means 11*b* and, optionally, can ensure static surfacing of the deep-sea device 1. The buoyancy unit 11*b* may be a glass hollow sphere system or a glass hollow sphere cement mixture with buoyancy properties.

On or in the head end region or at any other suitable point on the deep-sea device 1 are furthermore located sensors and signaling elements 213, which are used in particular during the surfacing process. They may be pressure or light sensors, but also acoustic sensors like directional microphones. It is possible that a guiding beam is generated preferably acoustically from the water surface, which allows the control of the direction of movement of the deep-sea device 1 and the steering of the deep-sea device 1 to a target region on the water surface. In this respect, e.g. a stereo or quadropolar acoustic directional receiving system is preferably installed on or in the head end region of the deep-sea device 1. Differential measurements of the signals permanently allow the determination of the deviation from the directional beam and the changing of the direction of movement of the deep-sea device 1 by means of rudder elements 220 and 221 on the rear of the deep-sea device 1.

The deep-sea device 1 furthermore comprises a space 214, in which required electronics e.g. for the sensor system, the dropping mechanism, the controller of the catching device 14, etc., are located. It is cast in gas-free and therefore does not have to be realized in a pressure-resistant manner.

As can be seen in FIG. 3, the individual functional parts, in particular the catching device 14 and parts of the drive unit 16, are accommodated in the main body 12, which is designed as a light-weight construction and preferably not pressure-resistant. The main body 12 may be e.g. a metallic, plastic or ceramic construction. The main body 12 is provided with openings (not represented), so that the inner pressure always follows the external pressure.

The catching device 14 comprises a chamber 24, in which at least one deep-sea object 13 may be accommodated and particularly caught. In the case of transport of the deep-sea object 13 while maintaining the pressure of the accommodation region of the deep-sea object 13, the catching device 14 is designed to be pressure-stable and is therefore thick-walled. Suitable dimensions are preferably a diameter of from a few centimeters up to a meter or even beyond. The catching device 14 and the chamber 24 possess an inlet opening Eö, which is closable with a closing part 22 (e.g. a door, flap, sliding element, etc.), which likewise withstands the pressure conditions in the deep-sea and during surfacing and can be closed actively, e.g. when a determination unit has detected an accommodated deep-sea object 13.

Arranged in the chamber 24 or the inlet opening Eö is an attracting means 222 with which deep-sea objects 13 are to be attracted into the chamber 24. The attracting means 222 may be a bait, an acoustic or an optical signal transmitter, which emits e.g. light flashes or sounds like the ones used by deep-sea objects 13 themselves for catching.

Alternatively or in addition, deep-sea water 13 may be sucked through the inlet opening Eö and then pumped out by means of a pump system, which comprises a pump 29 and a line 27, 28, until at least one deep-sea object 13 is accommodated in the catching device 14, in particular stands on a preferably plate-shaped screen or filter element 26. The screen element 26 has water passages through which the liquid flows, but which cannot be passed by a sucked deep-sea object 13.

By means of the determination unit (e.g. sensor, light barrier, contact sensor, etc.), it is possible to ascertain whether a deep-sea object 13 was accommodated. Depending thereon, the inlet opening Eö may be closed by means of the closing part 22.

The deep-sea device 1 shown in FIG. 3 further comprises a preparation device for at least one accommodated deep-sea object 13.

The preparation device comprises a fixing and/or dismantling element 25 for fixing and/or dismantling at least one deep-sea object 13. The fixing and/or dismantling element 25 is movable in the direction of the screen element 26, which may in addition or alternatively be designed likewise as a fixing and/or dismantling element. A detailed description of the function and mode of action thereof is given with reference to FIGS. 4 and 5.

The deep-sea device 1 shown in FIG. 3 further comprises a space 215, which accommodates drive electronics for the pump 29 as well as, in addition or alternatively, further loads, measurement module(s), sampling systems, etc. Furthermore, the space 215 is in direct contact with the external space and thus follows the external pressure.

The deep-sea device 1 further comprises a space 216, in which a battery system is accommodated. It is preferably a gas-free, film-like and non-compressible stack system or a different suitable battery form, like the one already used nowadays in deep-sea vessels.

The drive unit 16 shown in FIG. 3 comprises an electric motor 217 suitable for the deep-sea and a screw system 218, which can be driven by the electric motor 217. To avoid a torque transmitted to the deep-sea device 1, antagonistic twin screw systems are generally used.

Figure 4:
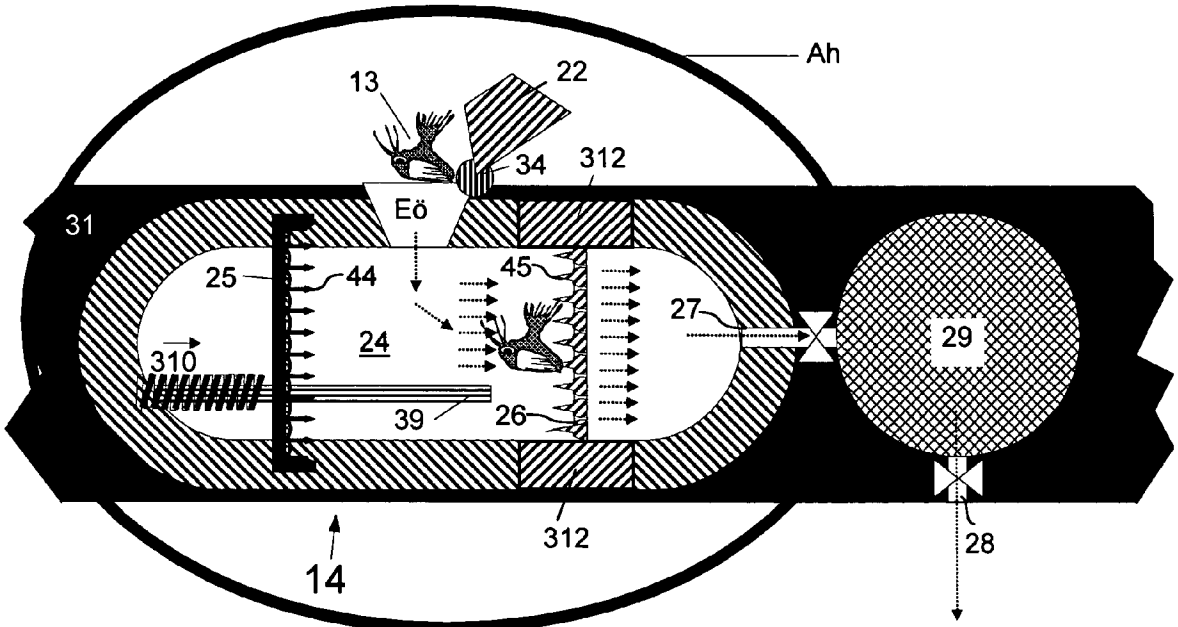
Figure 5:
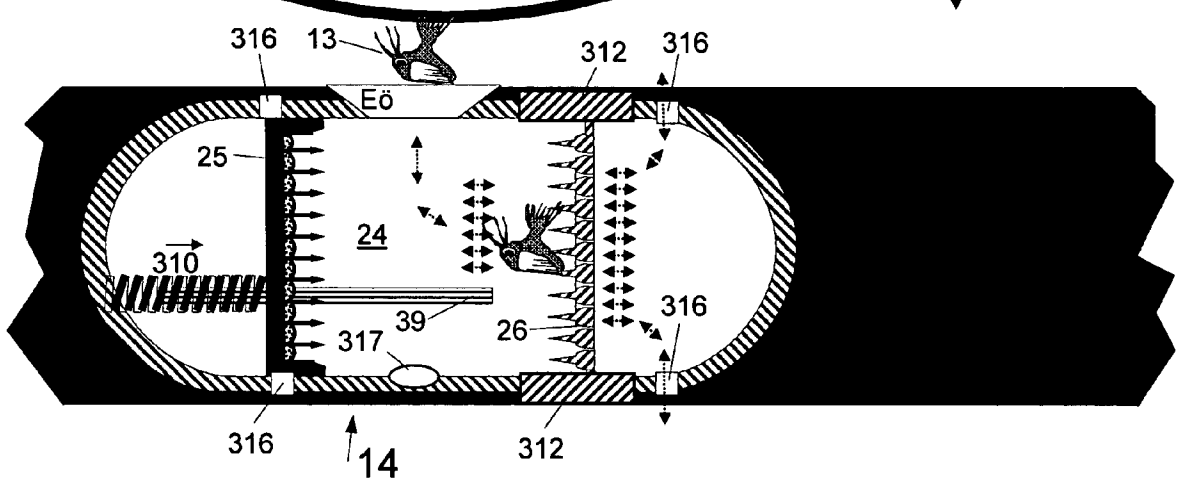

FIGS. 4 and 5 show two embodiments for the catching device 14. FIG. 4 shows an embodiment in which the pressure of the deep-sea object accommodating region may be maintained or controlled, whereas FIG. 5 shows an embodiment in which the pressure in the catching device 14 follows the external pressure.

The embodiment according to FIG. 4 serves for maintaining, until surfacing and recovering, the pressure conditions and preferably also the temperature conditions that were prevailing in the deep-sea object accommodating region, in particular with the aim of principally transferring living deep-sea organisms. For this purpose, the deep-sea device 1 according to FIG. 4 may comprise a pressure adjusting device and, preferably, also a temperature control device. The embodiment according to FIG. 5 serves in particular for extracting vital cells from the tissues while losing the vitality of the deep-sea organism.

In both embodiments, the catching device 14 comprises a preparation device in order to allow a preliminary preparation of at least one deep-sea object 13, e.g. a preparation for an intended isolation of vital cells and/or an establishment of cryosamples resp. in vitro cell cultures already prior to and during the surfacing. Likewise, the catching device 14 comprises in both embodiments the fixing and/or dismantling element 25 (hereinafter designated as fixing element) in order to fix and/or dismantle at least one deep-sea object 13.

Preparing the deep-sea object 13 is in particular required because the probability to be able to isolate living, propagatable cells dramatically decreases beginning with the time of catching. It is necessary to hurry up in particular for the following three reasons: first, because the whole organism would collapse due to smallest changes in the pressure and temperature conditions, which can hardly be avoided with increasing depth of catching, and secondly because the tolerance against clear pressure changes on the cellular and molecular levels exists only over a limited time period, and thirdly because the isolation of cells represents a further stress factor, besides the recovery stress, and consequently the whole stress period should be kept as short as possible.

By way of example, the preparation device and an associated preparation method will now be explained in more detail with reference to the embodiment according to FIG. 4.

After reaching the deep-sea, the inlet opening Eö of the catching device 14 may be opened by opening the closing means 22 e.g. by means of a mechanism 34 represented in a strongly simplified manner. Generally, however, the deep-sea device 1 is sunk with an opened inlet opening Eö into the deep-sea.

In FIG. 4, a deep-sea object 13 (e.g. a deep-sea macro-organism) is sucked into the catching device 14 and in particular into the chamber 24. The dotted arrows in FIG. 4 represent the direction of flow of the deep-sea water. Sucking is performed by means of the pump system, which comprises the pump 29 and the line 27, 28, wherein the line arranged upstream of the pump 29 and/or the line 28 arranged downstream of the pump 29 may have a valve in order to prevent a back-flow or passive flow out e.g. during the surfacing of the deep-sea device 1. Through sucking, the deep-sea object 13 is loaded against the screen element 26, whereas deep-sea water and small particles (in the millimeter and sub-millimeter range) pass through the intermediate spaces in the screen element 26.

The inlet opening Eö is located between the fixing element and the screen element 26. The fixing element 25 is axially movable e.g. by means of a preferably spring-loaded preloading mechanism 310 via a guide mechanism 39, formed here as a profile rod, in the direction of the screen element 25. Generally, this occurs rapidly (within a few seconds).

The fixing element 25 and the screen element 26 have fixing and/or dismantling parts 44, 45 (e.g. cutting means, piercing means such as nail-shaped, arrow-shaped or pin-shaped parts), which correspond with one another and are arranged in order to fix at least one deep-sea object 13 in a sandwich-like manner, e.g. by means of penetration, and/or to dismantle it by means of cutting. Using the fixing element 25, the deep-sea object 13 is pressed against the screen element 26 and dismantled into a smaller volume in which first preparation processes may be started.

If the fixing element 25 is located on the screen element 26, a deep-sea object setting unit is created, which can be removed by means of a connection device 312 preferably together with at least one accommodated deep-sea object 13 from the deep-sea device 1 and the remaining catching device 14. The connection device 312 may here be e.g. a pressure-tight screw connection or any other mechanism. Opening and removing the deep-sea object setting unit generally takes place on the surface, on board of a ship or in the laboratory and allows the rapid further processing of the deep-sea object 13 in the intended way.

In the embodiment shown in FIG. 5, the catching device 14 is not formed in a pressure-resistant manner and may therefore be designed to be thin-walled. The catching device 14 may thus comprise, in addition to the inlet opening Eö, further openings 316 through which water can flow in and flow out and a pressure equalization is achieved. The dotted arrows in FIG. 5 represent potential directions of flow of the deep-sea water.

If sucking is not desired, but instead e.g. a deep-sea object 13 is attracted with light flashes e.g. by means of an LED 317, a pump system may be dispensed with. In addition, the inlet opening Eö must not be closable with a closing means 22 if fixing of a deep-sea object 13 is allowed in the catching device 14. Conversely, fixing a deep-sea object 13 may be dispensed with if the closing means 22 is provided for.

Figure 6:
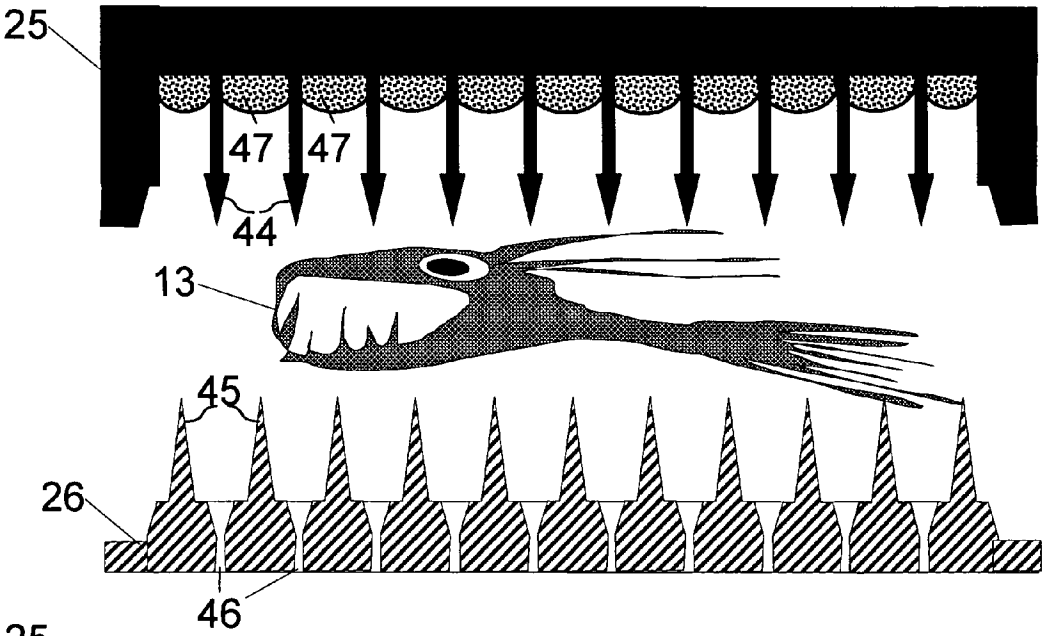
FIGS. 6 and 7: show schematic sectional views of an embodiment of a preparation device according to the invention for preparing a deep-sea object.
Figure 7:
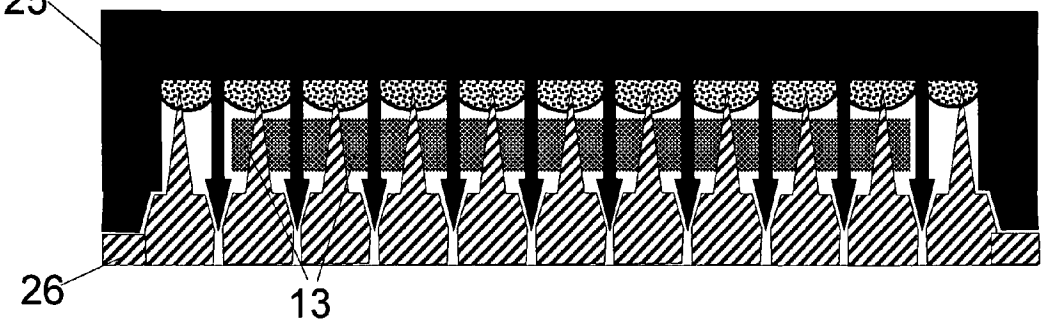

In FIGS. 6 and 7, the fixing element 25 and the screen element 26 are represented enlarged compared with the previous figures. In FIG. 6, the fixing element 25 and the screen element 26 are not yet engaged with each other and the deep-sea object 13 is still undamaged. In FIG. 7, the fixing element 25 and the screen element 26 are engaged with each other and the deep-sea object 13 is fixed in a sandwich-like manner between the fixing element 25 and the screen element 26 and penetrated, dismantled and is prepared for the isolation of vital cells after the recovery.

The screen element 26 comprises passages 46, which are arranged between the fixing parts 45 and through which water may flow, e.g. when the fixing element 25 is moved towards the screen element 26. The fixing element 25 comprises fixing parts 44, which are formed and arranged in order to pass through the passages 46 of the screen element 26 and in order to close them when the fixing element 25 is engaged with the screen element 26, whereby the intermediate space between the fixing element 25 and the screen element 26 and an accommodated deep-sea object 13 is isolated from surrounding water.

It is possible that the catching device 14 comprises receptacles 47 for active agent for the deep-sea object 13. In particular, volumina 47 closed with thin films may be arranged in intermediate spaces of the fixing element 25, which volumina contains e.g. an enzyme solution for dissolution of the tissue complex and/or a cryoprotectant for maintaining the vitality of cells during and after a freezing. Likewise, the receptacles 47 may also be provided for, in addition or alternatively, on the screen element 26 or at another suitable place.

Conveniently, the preparation process, in particular the tissue isolation, is activated already at the place of catching. To this effect, the deep-sea object 13 is fixed and dismantled in small pieces of tissue, and the receptacles 47 are opened by means of the fixing parts 45 of the screen element 26 so that the content of the receptacles 47 may flow into the tissue. Furthermore, the fixing parts 44 of the fixing element 25 tightly close the passages 46 of the screen element 26, so that no water reaches the deep-sea object 13 and the action of the active agent, in particular the concentration of the solution for dissolution of the tissue complex or for preparation of the cryopreservation, remains almost constant.

Figure 8:
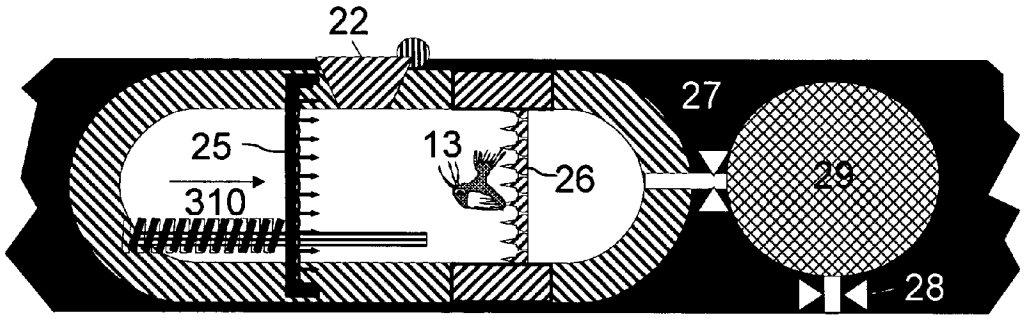
FIGS. 8 to 10: show schematic sectional views of a section of an embodiment of a deep-sea device according to the invention.
Figure 9:
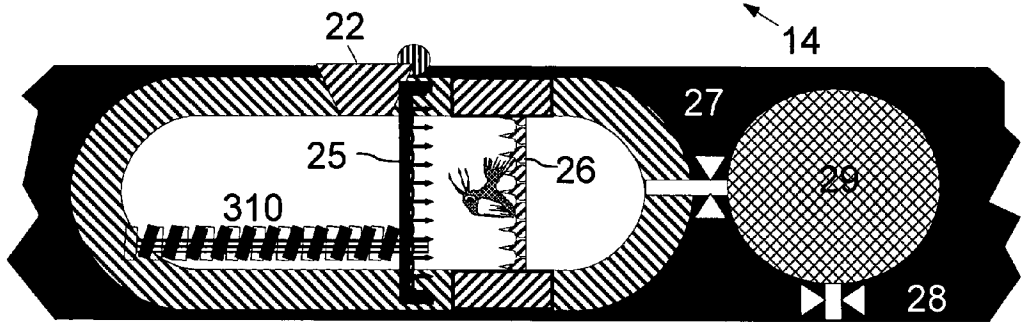
Figure 10:
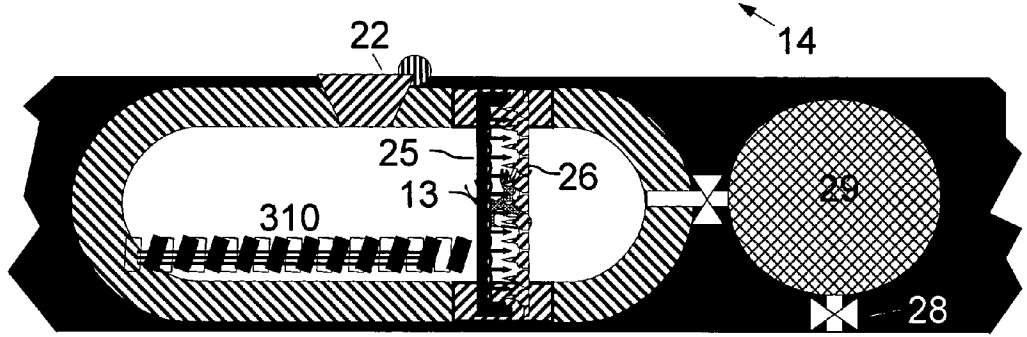

FIGS. 8 to 10 show the temporal course of the fixation, dismantling and preparation of a deep-sea object 13. This process may be executed very rapidly, e.g. within a second or less. The speed may be controlled e.g. by means of the preload of the pre-loading mechanism 310.

In FIGS. 8 to 10, again, a thick-walled, pressure-stable catching device 14 is represented. They once again show in particular the process of fixing and dismantling a deep-sea object 13, which may be supplemented at the same time and/or subsequently by the release of active agent. After fixing of the deep-sea object 13, valves arranged in the line 27, 28 are closed so that the pressure for the deep-sea object 13 accommodated in the catching device 14 can be maintained. If it is desired to catch but not to kill a deep-sea object 13 and to prepare the tissue, the function of dismantling may be dispensed with.

FIG. 11 shows once again the catching device 14 arranged in the deep-sea device 1, wherein the fixing element 25 and the screen element 26 are engaged with each other and a deep-sea object 13 is fixed and dismantled therebetween.

Figure 11:
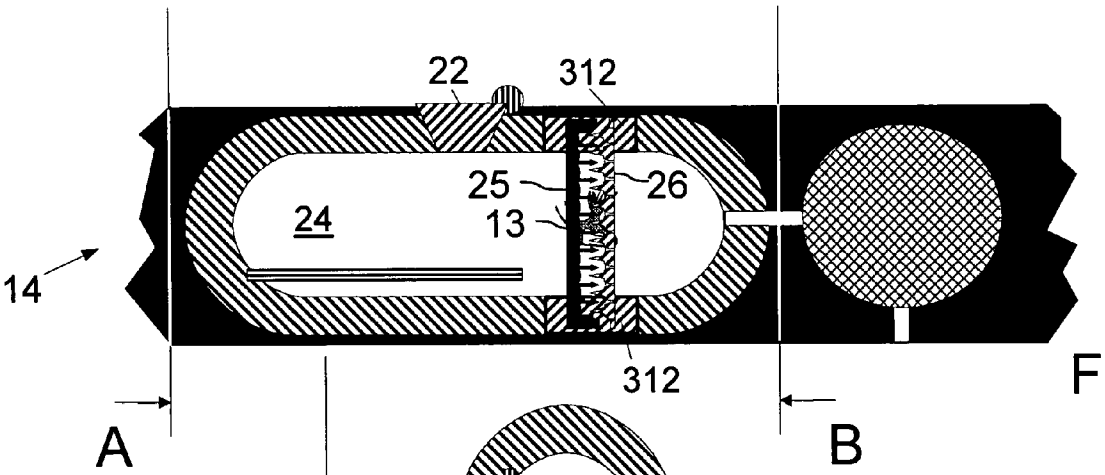
FIGS. 11 to 13: show schematic sectional views in particular of an embodiment of a catching device according to the invention.
Figure 12:
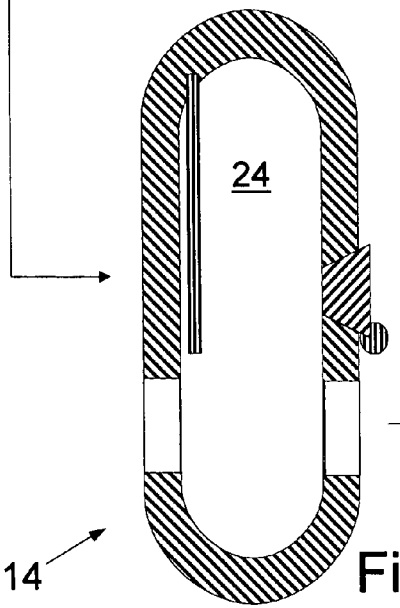
Figure 13:
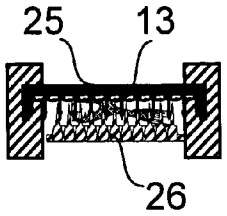

As can be seen in FIGS. 11 to 13, the catching device 14 may be removed modularly in parts or completely at positions A and B after surfacing of the deep-sea device 1 (e.g. disengaging by means of a quick release). A time period as short as possible between the catching and an optional fixing/dismantling and the further processing e.g. in the laboratory on board of a ship is essential for the recovering of vital material (organisms, tissue or cells). Therefore, the removal of the catching device 14 and, from the latter, of the deep-sea object setting unit as such (see FIG. 13), which in particular comprises the screen element 26 and the fixing element 25, plays an important role.

FIG. 12 shows the removed catching device 14, whereas FIG. 13 shows the removed deep-sea object setting unit as it is directly transferred to the laboratory for further processing. Likewise, embodiments are possible for which only a deep-sea object setting unit is removable from the deep-sea device 1, wherein the other parts of the catching device remain on or in the deep-sea device 1.

If one assumes e.g. catching at a depth of 6,000 m and surfacing with a speed of e.g. 60 km/h, the deep-sea device 1 would need 6 minutes to reach the surface. In this time, and it is here the otherwise usual time period for the action of enzymes for dissolution of the tissue complex resp. for penetration by antifreeze agents into the cells, the released substances are active to achieve preliminary preparation. In the case of guiding-beam guided surfacing of the deep-sea device 1, recovering is possible within 5 to 10 minutes. The removal of the complete catching device 14 or the deep-sea object setting unit and its transfer e.g. to the laboratory may take approx. 5 additional minutes. In the laboratory, pressure systems and further isolation containers can then be already available for generating of propagatable cell cultures or liquid nitrogen for the cryopreservation. Even for an unfavorable temporal course (e.g. 10 minutes for ascent time+10 minutes for recovering+10 minutes for transfer to the ship), the strain time of the cell material is less than 1 hour. Literature findings show that pressure changes are tolerable at the molecular and cellular level for up to one hour. In advantageous cases, the time elapsed from catching up to the laboratory is less than 15 minutes. The deep-sea device 1 according to the invention allows a recovering procedure, which is faster by the factor 10 to 30 than hitherto usual.

Figure 14:
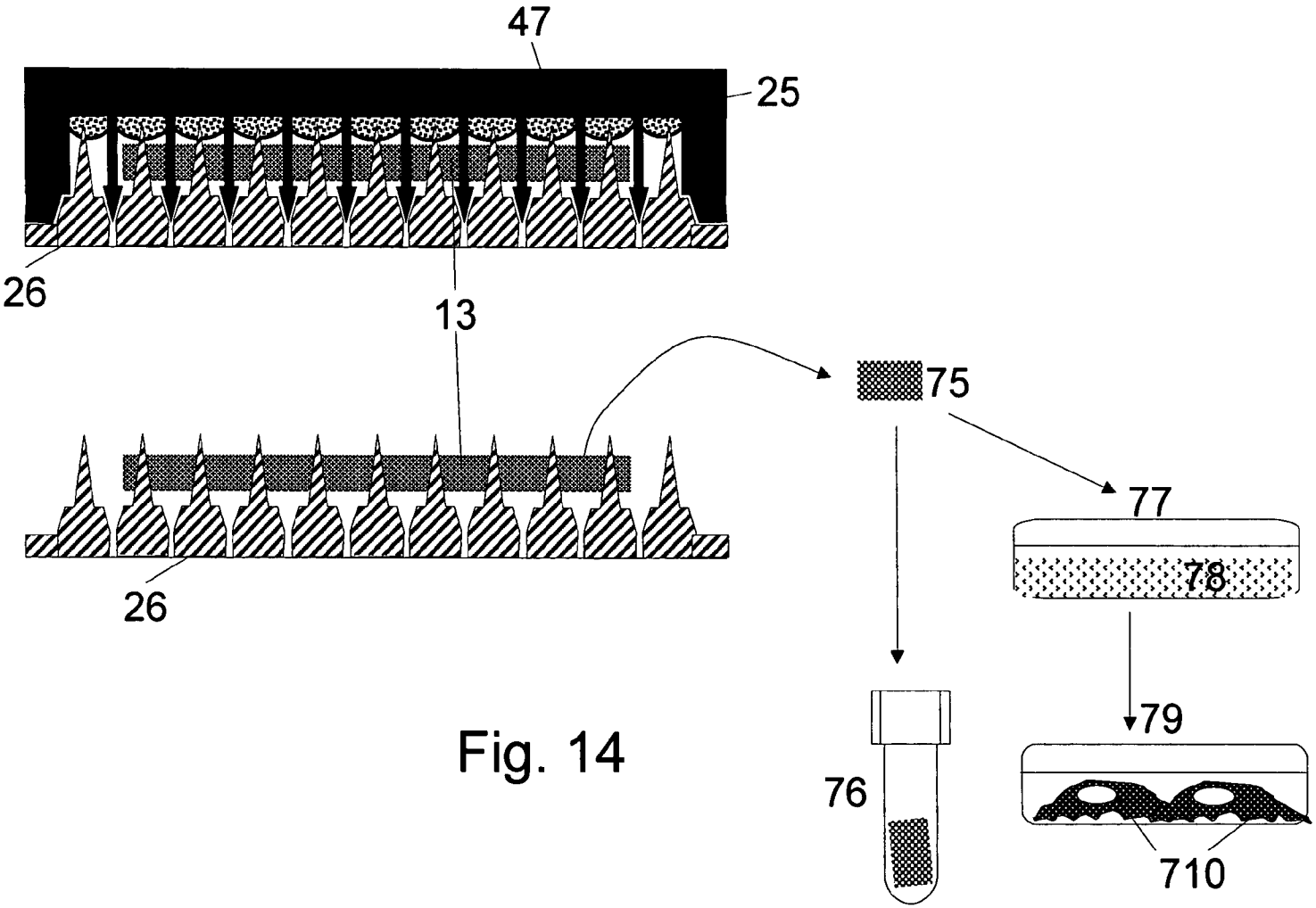
FIG. 14: shows a schematic sectional view of an embodiment of a preparation device according to the invention for preparing a deep-sea object and a further exemplary procedure after the recovery of the deep-sea object.

FIG. 14 shows, by way of example, a further procedure for tissue/cell processing after the recovery. To open the removed deep-sea object setting unit in the laboratory, the fixing element 25 and the screen element 26 are separated from each other. Thereupon, fractionated and, if applicable, pre-prepared tissue parts 75 of the deep-sea object 13 can be removed from the screen element 26 and further processed. Two ways are represented: first, freezing e.g. in plastic tubelets 76, in particular if antifreeze agents (e.g. DMSO, glycerine) were added beforehand, and secondly the generation of a primary cell culture 78 through adding enzyme and nutrient solutions in suitable containers 77 and their passaging until propagatable cells 710 grow stabily in culture. The procedure is preferably realized in such a way that the pressure and/or temperature conditions of the deep-sea are adjustable. At least, the phases from 75 via 77 to 79 should be carried out under deep-sea conditions. If this is not possible or not required (e.g. after recovering without a pressure chamber), deep-sea conditions (e.g. pressure, temperature) have to be established as quickly as possible after the cell isolation. Corresponding systems are known and have already been tested (see B. Shillito, G. Hamel, C. Duchi D. Cottin, J. Sarrazin, P.-M. Sarradin, J. Ravaux, F. Gaill, Live capture of megafauna from 2300 m depth, using a newly designed pressurized recovery device, Deep-Sea Research I 55 (2008) 881-889).

FIG. 15 shows an embodiment of a procedure for using the deep-sea device 1 for recovering at least one deep-sea object 13 (in particular vital deep-sea organisms).

At a deep-sea location 81, the deep-sea device 1 is thrown from aboard a ship 84 into the water. Owing to the weight part 11*a* of the deep-sea device 1, the deep-sea device 1 sinks with the weight part 11*a* being oriented towards the deep-sea bed 82 and the drive unit 16 being oriented towards the water surface. The deep-sea device 1 should sink up to the deep-sea bed 82, wherein catching and recovering may also be carried out without touching the ground at any depth above the deep-sea bed 82.

Section a) identifies passive sinking of the deep-sea device 1. In this phase, there is usually no need to rush.

Section b) identifies the arrival of the deep-sea device 1 at the deep-sea bed 82 where the deep-sea device 1 takes, depending on the surface contour of the deep-sea bed 82, a mostly substantially horizontal position. The spacer device Ah (not represented in FIG. 15) allows to prevent that the inlet opening Eö of the catching device 14 is closed by the deep-sea bed 82.

At least one deep-sea object 13' comes into the catching device 14 by means of attracting or sucking (Section c)). Once this is done and this has been ascertained by means of a determination unit, the catching device 14 is closed and, alternatively or in addition, the fixing, dismantling and/or active agent addition process is started.

In Section d), the weight means 11*a* is dropped and the deep-sea device 1 erects itself by means of the buoyancy unit 11*b* so that the buoyancy unit 11*a* resp. the head end of the deep-sea device 1 points towards the water surface and the drive unit 16 points towards the deep-sea bed 82 (Phase e)). Once the deep-sea device 1 is upright, the deep-sea device 1 or its longitudinal axis La is oriented substantially parallel to the buoyancy direction Ar and thus substantially perpendicular to a fictitious flat water surface F.

In the upright position, drive by means of the drive unit 16 and thus surfacing may take place (Section f)). The deep-sea device 1 is, on the way from the deep-sea towards the water surface, oriented substantially perpendicular to the fictitious flat water surface F and is substantially driven forward in the buoyancy direction Ar. Although not shown in FIG. 15, it is possible that the deep-sea device 1 is driven forward on the way from the deep-sea to the water surface in sections deviating from the buoyancy direction Ar, e.g. in order to ensure surfacing in a specific target region on the water surface.

The deep-sea device 1 is formed and configured in order to conform only either with the buoyancy direction Ar or a guiding beam or comprises a sensor device for detecting its position and/or orientation. In this case, the direction of movement of the deep-sea device 1 may be corrected by means of the control elements located on the rear.

Shortly before the surface is reached (e.g. within the last 100 m), the speed of the deep-sea device 1 may be decreased so that the deep-sea device 1 does not shoots out from the water surface. This can, however, also be advantageous since, in this manner, the place of surfacing can be detected with more ease (Section h)).

Sections i) and j) show by way of example how the deep-sea device 1 can be recovered, which, however, may also be carried out with a rubber boat or other systems.

On board of a ship 84 with a laboratory, further processing of the deep-sea object 13 takes place as already described (Section k)).

The invention is not limited to the preferred exemplary embodiments described above. Instead, a plurality of variants and modifications is possible, which also make use of the concept of the invention and thus fall within the scope of protection. The invention in particular also claims protection for the subject-matter of the individual sub-claims independently of the subject-matter of the claims referred to.

The invention claimed is:

1. A device for recovering at least one object from a body of water, having a surface and a bed, at a depth greater than 1000 meters beneath the surface, comprising:

a catching device configured to retrieve and contain at least one object at a depth greater than 1000 meters, and a drive unit configured to propel the—device, wherein the device has a forward and an aft end with said drive unit located at said aft end and configured to be propelled forward from a submersed location either directly or in stages towards the surface by the drive unit, wherein the device is configured to be driven forward oriented at least in stages substantially perpendicular to the surface, and wherein the catching device comprises at least one of the following:

a temperature control device configured to control a temperature of at least one of the catching device and the at least one object, or a pressure adjusting device configured to adjust a pressure in the catching device or for the at least one object.

2. The device according to claim 1, wherein the device is configured to be oriented with said forward end substantially facing the surface.

3. The device according to claim 1, wherein the device is configured to be driven forward oriented at least in stages substantially perpendicular to the surface.

4. The device according to claim 1, wherein the device comprises a droppable weight.

5. The device according to claim 1, wherein the device comprises a weight configured to let the deep-sea device sink with said forward end facing the bed.

6. The device according to claim 5, wherein the device comprises a buoyancy unit configured to orient the device with said forward end substantially facing the surface.

7. The device according to claim 6, wherein at least one of the weight and the buoyancy unit is arranged in said forward end of the device, and the device is substantially oriented with said forward end facing the surface after the weight has been dropped.

8. The device according to claim 4, wherein the device returns to the surface due to positive buoyancy after the weight has been dropped.

9. The device according to claim 1, wherein the catching device is closable in a water-proof and pressure resistant manner suitable for water depths below 1000 meters.

10. The device according to claim 1, wherein the catching device is configured to ensure a pressure, substantially equal to an external pressure at a depth to which the device has been exposed, in the catching device or for the at least one object.

11. The device according to claim 1, wherein the catching device comprises at least one of the following:

a chamber in which at least one object can be caught, a determination unit configured to determine whether at least one object is in the chamber, a closable chamber which is closed when a determination unit has determined the existence of at least one object in the chamber, an attractant for attracting at least one object into the chamber, a suction device for sucking at least one of at least one object and water into the chamber, and a screening device, against which at least object that has been sucked into the catching device is impingeable.

12. The device according to claim 1, further comprising a preparation device configured to at least one of dismantle and fix the at least one object in the catching device.

13. The device according to claim 1, further comprising a preparation device configured to supply at least one active agent to the at least one object in the catching device.

14. The device according to claim 1, further comprising at least one of a catching device and a preparation device, which is configured to substantially isolate the at least one object from the surrounding water or to recover the at least one object surrounded by surrounding water.

15. The device according to claim 12, wherein the at least one object in the catching device can be fixed by penetration or dismantled by cutting.

16. The device according claim 1, wherein the device comprises an elongated main body and the catching device is integrated into an interior of the elongated main body such that the catching device is at least partially removable and reattachable.

17. The device according claim 1, wherein the device comprises a connecting device for a pressure system.

18. The device according to claim 1, wherein the—device comprises at least one spacer device configured to prevent an inlet opening of the catching device being closed by a bed of the body of water.

19. The device according to claim 1, wherein the drive unit comprises at least one of the following:

a propeller drive unit, a screw drive unit, and a recoil drive unit.

20. The device according to claim 1, wherein the drive unit is formed and configured to propel the device with a speed, which is greater than 50 km/h.

21. The device according to claim 1, further comprising at least one of the following:

an adjustment system configured for adjusting at least one of the speed and the direction of movement of the device, and a sensor configured for detecting a directional beam.

22. The device according to claim 1, comprising a determining means configured to determine at least one of a position, a depth and an orientation of the device.

23. The device according to claim 1, wherein the at least one object comprises at least one of at least one organism and cell material.

24. A method for recovering at least one object from a depth below 1000 meters in a body of water having a surface and a bed using a device, comprising:

retrieving and housing the at least one object is by use of a catching device housed in the device, propelling the device at least in stages substantially in a direction towards a the water surface with a drive unit, wherein the device is configured to be driven forward oriented at least in stages substantially perpendicular to the surface, and wherein the catching device comprises at least one of the following:

a temperature control device configured to control a temperature of at least one of the catching device and the at least one object, or a pressure adjusting device configured to adjust a pressure in the catching device or for the at least one object.

25. The method according to claim 24, wherein the device is elongate and is oriented when at a depth below 1000 meters substantially perpendicular to the water surface, and is driven forward at least in stages oriented substantially perpendicular to the water surface.

26. The method according to claim 24, further comprising dropping a weight from the device.

27. The method according to claim 24, wherein the device is oriented by use of a buoyancy unit substantially perpendicular to the water surface.

28. The method according to claim 26, wherein the device is substantially oriented perpendicular to the water surface after the weight has been dropped.

29. The method according to claim 26, wherein the device returns to the surface by positive buoyancy after the weight has been dropped.

30. The method according to claim 24, wherein in the catching device at least one of the following is ensured:

the object is maintained at a temperature, which substantially corresponds to the temperature of the surrounding water where the object was retrieved, the object is maintained at a pressure, which substantially corresponds to the pressure of the surrounding water where the object was retrieved, and the object is maintained at a pressure, which substantially tracks pressure of the water surrounding the device.

31. The method according to claim 24, further comprising determining whether at least one object is in the catching device.

32. The method according to claim 24, further comprising closing a chamber when a determination unit has determined an existence of at least one object in the chamber.

33. The method according to claim 24, further comprising sucking the at least one of at least one object and water into a closable chamber.

34. The method according to claim 24, further comprising dismantling or fixing the at least one object in the catching device.

35. The method according to claim 24, further comprising supplying at least one active agent to the at least one object in the catching device.

36. The method according to claim 24, further comprising substantially isolating, the at least one object in the catching device from surrounding water or recovering the object surrounded by surrounding water.

37. The method according to claim 34, further comprising at least one of fixing by penetration and dismantling by cutting the at least one object in the catching device.

38. The method according to claim 24, further comprising propelling the device with a recoil drive unit with a speed, which is greater than 50 km/h.

39. The method according to claim 24, further comprising detecting a directional beam, and adjusting a direction of movement of the device depending on the detected directional beam.

40. The method according to claim 24, wherein the object comprises at least one of an organism and cell material.

41. The method of claim 24 wherein the device is further urged toward the water surface by positive buoyancy.

* * * * *